United States Patent [19]

Mitchell

[11] 4,448,619

[45] May 15, 1984

[54] EMULSION EXPLOSIVE COMPOSITION

[75] Inventor: Kenneth A. W. Mitchell, Cheltenham, Australia

[73] Assignee: ICI Australia Limited, Melbourne, Australia

[21] Appl. No.: 498,173

[22] Filed: May 25, 1983

[30] Foreign Application Priority Data

Jun. 11, 1982 [AU] Australia ..... PF4411

[51] Int. Cl.[3] ..... C06B 45/02

[52] U.S. Cl. ..... 149/21; 149/2; 149/40; 149/41; 149/42; 149/43; 149/44; 149/46; 149/60; 149/61; 149/71; 149/73; 149/77; 149/82; 149/83; 149/85

[58] Field of Search ..... 149/2, 21, 41, 43, 40, 149/42, 44, 46, 60, 61, 71, 73, 77, 82, 83, 85

[56] References Cited

U.S. PATENT DOCUMENTS

| | | | |
|---|---|---|---|
| 4,111,727 | 9/1978 | Clay | 149/61 |
| 4,181,546 | 1/1980 | Clay | 149/61 |
| 4,294,633 | 10/1981 | Clay | 149/60 |

*Primary Examiner*—Stephen J. Lechert, Jr.

*Attorney, Agent, or Firm*—Cushman, Darby & Cushman

[57] ABSTRACT

This invention concerns a water-in-oil emulsion explosive composition which comprises a discontinuous aqueous phase containing one or more oxygen-releasing salts, a continuous water-immiscible organic phase comprising sump oil, and an emulsifying agent. The explosive compositions show improved sensitivity over conventional compositions made using paraffin oil as the organic phase.

23 Claims, No Drawings

EMULSION EXPLOSIVE COMPOSITION

This invention relates to a water-in-oil emulsion explosive composition having a discontinuous aqueous phase and a continuous oil or water-immiscible liquid organic phase and in particular to a water-in-oil emulsion explosive composition containing sump oil as the continuous phase and to processes for the preparation thereof.

Emulsion explosive compositions have been widely accepted in the explosive industry because of their excellent explosive properties and ease of handling. The emulsion explosive compositions now in common use in the industry were first disclosed by Bluhm in U.S. Pat. No. 3,447,978 and comprise three essential components: (a) a discontinuous aqueous phase comprising discrete droplets of an aqueous solution of inorganic oxygen-releasing salts; (b) a continuous water-immiscible organic phase throughout which the droplets are dispersed; and (c) an emulsifier which forms an emulsion of the droplets of oxidizer salt solution throughout the continuous organic phase.

A wide range of oils may be used as the continuous, water-immiscible organic phase, or fuel, in emulsion explosive compositions. However, it is well known in the art that best results, in terms of sensitivity and storage stability, are obtained when such compositions are prepared using refined paraffin oil.

Surprisingly, it has now been found that the use of sump oil, that is used motor lubricating oil, as the continuous water-immiscible organic phase in water-in-oil emulsion explosive compositions gives emulsions which have a higher sensitivity than conventional water-in-oil emulsion explosive compositions.

Accordingly the invention provides a water-in-oil emulsion explosive composition comprising a discontinuous aqueous phase comprising at least one oxygen-releasing salt, a continuous water-immiscible organic phase comprising sump oil, and an emulsifying agent.

Suitable oxygen-releasing salts for use in the aqueous phase component of the composition of the present invention include the alkali and alkaline earth metal nitrates, chlorates and perchlorates, ammonium nitrate, ammonium chlorate, ammonium perchlorate and mixtures thereof. The preferred oxygen-releasing salts include ammonium nitrate, sodium nitrate and calcium nitrate.

Typically, the oxygen-releasing salt component of the compositions of the present invention comprises from 60 to 95% and preferably from 70 to 90% by weight of the total composition. In compositions wherein the oxygen-releasing salt comprises a mixture of ammonium nitrate and sodium nitrate the preferred composition range for such a blend is from 5 to 40 parts of sodium nitrate for every 100 parts of ammonium nitrate. Therefore, in the preferred compositions of the present invention the oxygen-releasing salt component comprises from 70 to 90% by weight (of the total composition) ammonium nitrate or a mixture of from 5 to 30% by weight (of the total composition) sodium nitrate and from 40 to 85% by weight (of the total composition) ammonium nitrate.

In the preparation of the compositions of the present invention preferably all of the oxygen-releasing salt is in aqueous solution. Typically, the amount of water employed in the compositions of the present invention is in the range of from 2 to 30% by weight of the total composition. Preferably the amount employed is from 5 to 25%, and more preferably from 10 to 20%, by weight of the total composition.

The water-immiscible organic phase component of the composition of the present invention comprises sump oil as the continuous "oil" phase of the water-in-oil emulsion and comprises the fuel. The term "sump oil" is used herein to mean used motor lubricating oil. Optionally the sump oil may be mixed with other water-immiscible organic fuels such as fuel oil, diesel oil, distillate, kerosene, naphtha, waxes, paraffin oils, benzene, toluene, xylenes, asphaltic materials, polymeric oils such as the low molecular weight polymers of olefins, animal oils, fish oils, and other mineral, hydrocarbon or fatty oils, and mixtures thereof.

The significant economic and environmental advantages of using sump oil as the continuous oil phase in water-to-oil emulsion explosive compositions will be evident to those skilled in the art. In general sump oil is regarded as waste which is difficult to dispose of in an environmentally acceptable manner and is therefore readily available and inexpensive. Moreover, not only does the use of sump oil have economic and environmental advantages but, completely unexpectedly, the use of sump oil leads to an explosive composition having a significantly improved sensitivity and storage stability. Therefore, preferably the water-immisible organic phase component of the composition of the present invention comprises at least 20% by weight of sump oil.

Typically, the organic fuel or continous phase of the emulsion explosive composition of the present invention comprises from 2 to 15% by weight and preferably 5 to 10% by weight of the total composition.

The emulsifying agent component of the composition of the present invention may be chosen from the wide range of emulsifying agents known in the art for the preparation of water-in-oil emulsion explosive compositions. Examples of such emulsifying agents include alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbital esters, poly(oxyalkylene) sorbitan esters, fatty amine alkoxylates, poly(oxyalkylene)glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof. Among the preferred emulsifying agents are the 2-alkyl- and 2-alkenyl-4,4'-bis(hydroxymethyl)oxazolines, the fatty acid esters of sorbitol, lecithin, copolymers of poly(oxyalkylene) glycols and poly(12-hydroxystearic acid), and mixtures thereof, and particularly sorbital mono-oleate, sorbitan sesquioleate, 2-oleyl-4,4'-bis(hydroxymethyl)oxazoline, a mixture of sorbitan sesquioleate, lecithin and a copolymer of poly(oxyalkylene) glycol and poly(12-hydroxystearic acid), and mixtures thereof.

Typically, the emulsifying agent component of the composition of the present invention comprises up to 5% by weight of the total composition. Higher proportions of the emulsifying agent may be used and may serve as a supplemental fuel for the composition but in general it is not necessary to add more than 5% by weight of emulsifying agent to achieve the desired effect. One of the advantages of the compositions of the present invention is that stable emulsions can be formed using relatively low levels of emulsifying agent and for reasons of economy it is preferable to keep the amount of emulsifying agent used to the minimum required to have the desired effect. The preferred level of emulsifying agent used is in the range from 0.1 to 2.0% by weight of the total composition.

Preferably, the emulsion explosive compositions of the present invention comprise a density reducing agent to reduce their density and enhance their sensitivity. The agent may be incorporated into the compositions of the present invention as fine gas bubbles dispersed throughout the composition, hollow particles which are often referred to as microballoons, porous particles, or mixtures thereof. A discontinuous phase of fine gas bubbles may be incorporated into the compositions of the present invention by mechanical agitation, injection or bubbling the gas through the composition, or by in situ generation of the gas by chemical means. Suitable for the in situ generation of gas bubbles include peroxides such as, for example, hydrogen peroxide, nitrites such as, for example sodium nitrite, nitrosoamines such as, for example, N,N'-dinitrosopentamethylene tetramine, alkali metal borohydrides such as, for example, sodium borohydride, and carbonates such as sodium carbonate. Preferred chemicals for the in situ generation of gas bubbles are nitrous acid and its salts which decompose under conditions of acid pH to produce gas bubbles. Thiourea may be used to accelerate the decomposition of a nitrite gassing agent. Examples of suitable hollow particles include small hollow microspheres of glass and resinous materials such as phenol-formaldehyde and urea-formaldehyde. Examples of suitable porous materials include expanded minerals such as perlite.

If desired other, optional fuel materials, hereinafter referred to as secondary fuels, may be incorporated into the compositions of the present invention in addition to the water-immiscible organic fuel phase. Examples of such secondary fuels include finely divided solids, and water-miscible organic liquids which can be used to partially replace water as a solvent for the oxygen-releasing salts or to extend the aqueous solvent for the oxygen-releasing salts. Examples of solid secondary fuels include finely divided materials such as: sulfur; aluminium; and carbonaceous materials such as gilsonite, comminuted coke or charcoal, carbon black, resin acids such as abietic acid, sugars such as glucose or dextrose and other vegetable products such as starch, nut meal, grain meal and wood pulp. Examples of water-miscible organic liquids include alcohols such as methanol, glycols such as ethylene glycol, amides such as formamide and amines such as methylamine.

Typically, the optional secondary fuel component of the compositions of the present invention comprise from 0 to 30% by weight of the total composition.

The oxygen balance of the compositions of the present invention is not narrowly critical. In order to obtain best performance from the compositions preferably their oxygen balance is in the range of from +0.5% to −1.5%. However, compositions having satisfactory performance can be prepared which have a highly negative oxygen balance.

The emulsion explosive compositions of the present invention which comprise sump oil as the sole component of the continuous organic phase or fuel have a surprisingly high viscosity when compared to prior art compositions prepared from fuels which are fluid at ambient temperatures. This property of the compositions of the present invention can be advantageous in the preparation of viscous water-in-oil emulsion explosive compositions for use in up-holes where viscous or gelled compositions are required to avoid loss of the explosive composition from the hole.

Viscous water-in-oil emulsion explosive compositions can be made according to the prior art by incorporating into the continuous organic phase fuels such as waxes which are solids at ambient temperatures. However, in order to prepare such compositions the continuous organic phase must be heated to a temperature above the melting point of the wax. In contrast as sump oil is fluid at ambient temperatures viscous water-in-oil emulsion explosive compositions of the invention may be prepared without the need to heat the continuous organic phase prior to emulsification, which is a decided advantage in the on-site preparation of bulk emulsion explosive compositions.

Although it is neither necessary nor preferable to incorporate thickening and or crosslinking agents in the emulsion explosive compositions of the present invention, if desired, the aqueous phase of the compositions of the present invention may comprise optional thickening agent(s) which optionally may be crosslinked. The thickening agents, when used in the compositions of the present invention,are suitably polymeric materials, especially gum materials typified by the galactomannan gums such as locust bean gum or guar gum or derivatives thereof such as hydroxypropyl guar gum. Other useful, but less preferred, gums are the so-called biopolymeric gums such as the heteropolysaccharides prepared by the microbial transformation of carbohydrate material, for example the treatment of glucose with a plant pathogen of the genus Xanthomonas typified by *Xanthomonas campestris.* Other useful thickening agents include synthetic polymeric materials and in particular synthetic polymeric materials which are derived, at least in part, from the monomer acrylamide.

Typically, the optional thickening agent component of the compositions of the present invention comprises from 0 to 2% by weight of the total composition.

As indicated above, when used in the compositions of the present invention, the thickening agent optionally may be crosslinked. It is convenient for this purpose to use conventional crosslinking agents such as zinc chromate or a dichromate either as a separate entity or as a component of a conventional redox system such as, for example, a mixture of potassium dichromate and potassium antimony tartrate.

Typically, the optional crosslinking agent component of the compositions of the present invention comprises from 0 to 0.5% and preferably from 0 to 0.1% by weight of the total composition.

The pH of the emulsion explosive compositions of the present invention is not narrowly critical. However, in general the pH is between 0 and 8 and preferably the pH is between 1 and 5.

The emulsion explosive compositions of the present invention may be prepared by a number of methods. Preferably the compositions are prepared by:

(a) dissolving said oxygen-releasing salts in water at a temperature above the fudge point of the aqueous salt solution;

(b) combining said aqueous salt solution, said water-immiscible organic phase and said emulsifying agent with rapid mixing to form a water-in-oil emulsion;

(c) mixing until the emulsion is uniform; and (d) optionally mixing into the emulsion any solid ingredients and/or density reducing agents.

Possible variations of this general procedure will be evident to those skilled in the art of the preparation of emulsion explosive compositions.

In yet a further embodiment the invention provides a method for the preparation of the novel emulsion explosive compositions herein described.

The invention is now illustrated by, but is not limited to, the following Examples in which all parts and percentages are expressed on a weight basis unless otherwise specified.

EXAMPLE 1

This Example illustrates the preparation of a water-in-oil emulsion explosive composition of the present invention.

A mixture of ammonium nitrate (2512.8 parts), sodium nitrate (740 parts) and water (443.2 parts) was heated with stirring to a temperature of 90° C. to give an aqueous solution. The hot aqueous solution was added, with rapid stirring, to a solution of 2-oleyl-4,4'-bis(hydroxymethyl)oxazoline (40 parts) in sump oil (204) parts. Stirring was continued until a uniform emulsion was obtained. Glass micro-balloons (100 g) were added to the emulsion and thoroughly mixed therein. The composition was packaged into 25 mm diameter waxed paper cartridges and allowed to cool.

The emulsion explosive composition prepared as described above had a density of 1.13 g/cc and an average aqueous phase droplet size in the range from 1 to 4 microns.

EXAMPLE 2

This Example illustrates the improved detonation sensitivity of an explosive composition of the present invention.

The explosive compositions prepared as described in Example 1 were tested for detonation sensitivity by firing in a test cell at a temperature of 8° C. For comparison, explosive compositions using paraffin oil as the oil phase were prepared following the same procedure described in Example 1 and stored and test fired under the same conditions as the explosive composition of the present invention.

The results are detailed in Table 1 below.

TABLE 1

| Composition | Blasting Cap No 6 | 3 | 2 | 1 |
|---|---|---|---|---|
| Example 1 | Fired | Fired | Fired | Fired |
| Example 1 | — | — | Fired | Fired |
| Comparative | Fired | Fired | Failed | — |
| Comparative | — | — | Failed | — |

The results that demonstrate the explosive composition of the invention fires reliably with a number 1 blasting cap (0.2 g ASA blasting compound) whereas the conventional prior art composition fails to fire with both number 1 and number 2 (0.4 g ASA) blasting caps firing only with a number 3 (0.6 g ASA) blasting cap.

The composition of the present invention and the comparative composition had the same velocity of detonation as measured using Dautrich Plates.

EXAMPLES 3–6

The following general procedure was used to prepare a number of compositions of the present invention.

An aqueous oxidizer salt solution was prepared by dissolving the oxidizing salt(s) in water at a temperature of 90° C.

The hot aqueous oxidizer salt solution was added to the hot continuous phase, comprising the oil or fuel and the emulsifying agent, while stirring at approximately 200 rpm in a Hobart Mixer Model 120A (Trade Mark). The emulsion was refined by mixing for a further 5 minutes at approximately 350 rpm and then glass micro-balloons or a gassing agent were added and thoroughly blended into the emulsion. Samples of the composition were than run off into 85 mm diameter waxed cardboard tubes for testing purposes and allowed to cool to ambient temperature.

The compositions detailed in Table 2 below were prepared following the above procedure.

TABLE 2

| Components (parts by weight) | Example No 3 | 4 | 5 | 6 |
|---|---|---|---|---|
| Ammonium Nitrate | 9192 | 12117 | 9192 | 12117 |
| Sodium Nitrate | 3104 | 2946 | 3104 | 2946 |
| Water | 2739 | 2739 | 2739 | 2739 |
| Sump Oil | 442 | 442 | 442 | 442[d] |
| Emulsifier | 48[a] | 48[a] | 112[c] | 48[a] |
| Density Reducer | 15[b] | 15[b] | 15[b] | 15[b] |

[a]Sorbitan monoleate

[b]Solution of sodium nitrite in water (2:1)

[c]Mixture of sorbitan sesquioleate (48 parts), soya lecithin (48 parts) and an ABA block copolymer of poly(12-hydroxystearic acid) and polyethylene glycol (16 parts).

[d]Mixture of sump oil (332 parts) and distillate (110 parts)

EXAMPLE 7

This Example demonstrates the improved storage stability of the explosive compositions of the present invention.

In order to evaluate their storage stability samples of the explosive compositions of the invention prepared as described in Examples 3, 4, 5 and 6 were tested by detonation using 30 g "Anzomex" A primers ("Anzomex" is a Trade Mark and "Anzomex" A comprises a 60:40 mixture of pentaerythritol tetranitrate and (trinitrotoluene) when fresh and after storage.

For the purpose of comparison explosive compositions not of the invention were prepared following the procedures described above for Examples 3 and 4 but substituting distillate for the sump oil used in those Examples. For convenience these comparative examples will be referred to as Comparative 3 and Comparative 4 respectively. In order to evaluate their storage stability samples of the explosive compositions of these comparative examples were fired under the same conditions as the explosive compositions of the present invention.

The results are detailed in Table 3 below.

TABLE 3

| Composition (density g/cc) | Result of Detonation Attempt after Storage (days) (Bubble Energy in MJ/kg) 0 | 2 | 14 | 30 | 48 |
|---|---|---|---|---|---|
| Example 3 | FD | — | — | FD | — |
| (1.18) | (1.73) | — | — | (1.77) | — |
| Example 4 | FD | — | — | FD | — |

TABLE 3-continued

| Composition (density g/cc) | Result of Detonation Attempt after Storage (days) (Bubble Energy in MJ/kg) | | | | |
|---|---|---|---|---|---|
| | 0 | 2 | 14 | 30 | 48 |
| (1.04) | (1.83) | — | — | (1.83) | — |
| Example 5 | FD | — | FD | — | — |
| (1.10) | (1.83) | — | (1.82) | — | — |
| Example 6 | FD | — | FD | — | FD |
| (1.06) | (1.69) | — | (1.72) | — | — |
| Comparative 3 | — | PD | — | — | — |
| (1.14) | — | — | — | — | — |
| Comparative 4 | FD | — | ND | — | — |
| (1.10) | (1.54) | — | — | — | — |

Code:
FD Full Detonation
PD Partial Detonation
ND No Detonation
—Not Tested

EXAMPLE 8

This Example illustrates the preparation of a water-in-oil emulsion explosive composition of the present invention.

A mixture of ammonium nitrate (2648 parts), sodium nitrate (529 parts), water (448 parts) was heated with stirring to a temperature of 90° C. to give an aqueous solution. The hot aqueous solution was added with stirring on speed 2 of a Hobart Mixer to a hot solution of sump oil (36 parts), paraffin wax (77 parts), microcrystalline wax (76 parts) and sorbitan mono-oleate (54 parts). After 2 minutes mixing on speed 2 the emulsion was refined by mixing for a further 5 minutes on speed 3 of the mixer. C15/250 grade glass microballoons (132 parts) were added to the emulsion and thoroughly mixed therein. Samples of the composition were packaged into 25 mm diameter waxed paper cartridges and allowed to cool.

EXAMPLE 9

This Example demonstrates the improved sensitivity and storage stability of the explosive compositions of the present invention.

The explosive composition prepared as described in Example 8 was tested for detonation sensitivity by firing a fresh sample in a test cell at a temperature of 9° C. and firing under the same conditions a sample which had been stored at a temperature of 35° C. for a period of 3 months in accelerated storage trials.

For the purpose of comparison an explosive composition not of the invention was prepared following the same procedure as that described in Example 8 but substituting paraffin oil for sump oil used in that Example. For convenience this comparative example will be referred to as Comparative 8. In order to evaluate its detonation sensitivity after storage samples of the explosive composition of this comparative example were stored and fired under the same conditions as the samples of the explosive composition of Example 8.

The results are detailed in Table 4 below.

TABLE 4

| Composition (Density g/cc) | Result of Attempt to Detonate with Blasting Cap No (Velocity of Detonation km/sec) | | |
|---|---|---|---|
| | 8 | 6 | 2 |
| Example 8 (1.07) | | | |
| Fresh | Fired | Fired | Fired (4.5) |

TABLE 4-continued

| Composition (Density g/cc) | Result of Attempt to Detonate with Blasting Cap No (Velocity of Detonation km/sec) | | |
|---|---|---|---|
| | 8 | 6 | 2 |
| After Storage | Fired | Fired (4.4) | — |
| Comparative 8 (1.08) | | | |
| Fresh | Fired | Fired | Fired (4.4) |
| After Storage | Fired (4.4) | Failed | Failed |

The results demonstrate that the explosive composition of the invention fires reliably with a number 6 blasting cap even after accelerated storage 35° C. for three months whereas the comparative composition fires reliably only with a number 8 blasting cap after the same accelerated storage conditions.

EXAMPLES 10–12

These Examples demonstrate the preparation of water-in-oil emulsion explosive compositions of the present invention having a range of viscosities.

Explosive compositions of the invention were prepared following the procedure described in Example 5 but substituting for the sump oil used in that Example mixtures of sump oil and distillate.

For the purpose of comparison, two explosive compositions not of the invention were prepared following the procedure described in Example 5 but substituting for the sump oil used in that Example paraffin oil and distillate. For convenience these comparative examples will be referred to as Comparative 9 and Comparative 10 respectively.

The viscosities of the above compositions were determined at 65° C. using a Brookfield Viscometer (Trade Mark) and are reported in Table 5 below.

TABLE 5

| Composition | Oil (parts by weight) | Viscosity (centipoise) |
|---|---|---|
| Example 5 | Sump Oil (442) | $164 \times 10^5$ |
| Example 10 | Sump Oil (332)<br>Distillate (110) | $76 \times 10^5$ |
| Example 11 | Sump Oil (221)<br>Distillate (221) | $56 \times 10^5$ |
| Example 12 | Sump Oil (110)<br>Distillate (332) | $44 \times 10^5$ |
| Comparative 9 | Paraffin (442) | $60 \times 10^5$ |
| Comparative 10 | Distillate (442) | $28 \times 10^5$ |

EXAMPLES 13 AND 14

These Examples demonstrate the preparation of water-in-oil emulsion explosive compositions of the present invention having very low levels of emulsifying agent.

The general procedure described for Examples 3 to 6 was repeated using ammonium nitrate (3360 parts), sodium nitrate (1140 parts), water (1000 parts), sump oil (410 parts) and various concentrations of emulsifier.

For the purpose of comparison, an explosive composition not of the invention was prepared following the same procedure but substituting furnace oil for sump oil. For convenience this comparative example will be referred to as Comparative 14.

The viscosities of the above compositions was determined at 65° C. using a Brookfield Viscometer (Trade Mark) and are reported in Table 6 below together with details on the emulsifier content and emulsion stability.

TABLE 6

| Composition | Emulsifier Concentration (% w/w) | Viscosity (centipoise) | Emulsion Stability (after 7 days) |
|---|---|---|---|
| Example 13 | 1.9 | $120 \times 10^5$ | Very good |
| Example 14 | 0.5 | $112 \times 10^5$ | Very good |
| Comparative 14 | 0.5 | $164 \times 10^5$ | Broke down within 3 days |

EXAMPLE 15

This Example demonstrates the continuous preparation of a water-in-oil emulsion explosive composition of the present invention using a hydraulically driven pin-mill.

An aqueous oxidizer solution comprising ammonium nitrate (7577 parts), sodium nitrate (494 parts) and water (1832 parts) at a temperature of 80° C. was blended with a cold oil phase comprising sump oil (402 parts), distillate (134 parts) and sorbitan mono-oleate (96 parts) in a pin-mill operating at 450 rpm. The emulsion from the pin-mill was fed to a blender and mixed with sufficient aqueous sodium nitrite solution (33% w/w) to give the product a density of 1.06–1.10 g/cc and samples of the gassed emulsion were loaded into cylindrical plastic bags for testing.

Samples of the emulsion were fired successfully using 30 g "Anzomex" A primer with a velocity of detonation of 5.1 km/sec and a critical diameter of less than 30 mm.

EXAMPLES 16 TO 20

These Examples demonstrate water-in-oil emulsion explosive compositions of the present invention having a range of components and properties.

The general procedure described for Examples 3 to 6 was repeated to prepare the compositions of the invention detailed in Table 7 below. The properties of the compositions are reported in Table 8 below.

TABLE 7

| Components (parts by weight) | Example No 16 | 17 | 18 | 19 | 20 |
|---|---|---|---|---|---|
| Ammonium Nitrate | 4849 | 6566 | 7005 | 7570 | 5450 |
| Sodium Nitrate | — | 1639 | — | — | 1820 |
| Calcium Nitrate | 3229 | — | — | — | — |
| Water | 898 | 917 | 2332 | 1840 | 1600 |
| Sump Oil | 683 | 537 | 322 | 410 | 280 |
| Emulsifier | 98[a] | 98[a] | 98[a] | 100[c] | 140[e] |
| Atomized Aluminium | — | — | — | — | 500 |
| Density Reducer | 244[b] | 244[b] | 244[b] | 6[d] | 30[d] |

[a]2-Oleyl-4,4'-bis(hydroxymethyl)oxazoline
[b]C15/250 Glass microballoons
[c]Sorbitan mono-oleate
[d]Aqueous sodium nitrite (33% w/w)
[e]Mixture of sorbitan sesquioleate (60 parts), soya lecithin (60 parts) and an ABA block copolymer of poly(12-hydroxystearic acid) and polyethylene glycol (20 parts)

TABLE 8

| Property | Example No 16 | 17 | 18 | 19 | 20 |
|---|---|---|---|---|---|
| Density (g/cc) | 1.22 | 1.22 | 1.06 | 1.27 | 1.19 |
| Sensitivity[a] (blasting cap no) | [b] | 3 | 8 | — | — |
| Velocity of Detonation[c] (km/sec) | 3.1 | 4.4 | 4.2 | — | — |
| Bubble Energy MJ/kg | — | — | — | 1.67[d] | 2.09[e] |

[a]Minimum blasting cap required for reliable detonation of a 25 mm diameter sample at 7–9° C.
[b]10 g of pentolite
[c]Determined using 25 mm diameter samples at 7–9° C.
[d]Determined on 130 mm diameter samples at 20° C. using a 30 g pentolite primer
[e]Determined on 130 mm diameter samples at 16° C. using a 140 g pentolite primer

I claim:

1. A water-in-oil emulsion explosive composition which comprises a discontinuous aqueous phase comprising at least one oxygen-releasing salt, a continuous water-immiscible organic phase comprising sump oil, and an emulsifying agent.

2. An emulsion explosive composition according to claim 1 wherein said oxygen-releasing salt is selected from the group consisting of the alkali metal, alkaline earth metal and the ammonium, nitrates, chlorates and perchlorates, and mixtures thereof.

3. An emulsion explosive composition according to claim 1 or claim 2 wherein said oxygen-releasing salt is selected from the group consisting of ammonium nitrate, sodium nitrate, calcium nitrate and mixtures thereof.

4. An emulsion explosive composition according to any one of claims 1 to 3 inclusive wherein the oxygen-releasing salt component comprises from 60 to 95% by weight of the total composition.

5. An emulsion explosive composition according to any one of claims 1 to 4 inclusive wherein said continuous water-immiscible organic phase comprises in addition to said sump oil at least one further water-immiscible organic fuel.

6. An emulsion explosive composition according to claim 5 wherein said further water-immiscible organic fuel is selected from the group consisting of fuel oil, diesel oil, distillate, furnace oil, kerosene, naphtha, waxes, paraffin oil, benzene, toluene, xylenes, asphaltic materials, polymeric oils, animal oils, fish oils and mixtures thereof.

7. An emulsion explosive composition according to claim 5 or claim 6 wherein said further water-immiscible organic fuel is selected from the group consisting of fuel oil, diesel oil, distillate, furnace oil, waxes and paraffin oil.

8. An emulsion explosive composition according to any one of claims 1 to 7 inclusive wherein said continuous water-immiscible organic phase comprises from 2 to 15% by weight of the total composition.

9. An emulsion explosive composition according to any one of claims 1 to 8 inclusive wherein said emulsifying agent is selected from the group consisting of alcohol alkoxylates, phenol alkoxylates, poly(oxyalkylene) glycols, poly(oxyalkylene) fatty acid esters, amine alkoxylates, fatty acid esters of sorbitol and glycerol, fatty acid salts, sorbitan esters, poly(oxyalkylene) sorbitan esters, fatty amine alkoxylates, poly(oxyalkylene)glycol esters, fatty acid amides, fatty acid amide alkoxylates, fatty amines, quaternary amines, alkyloxazolines, alkenyloxazolines, imidazolines, alkylsulfonates, alkylarylsulfonates, alkylsulfosuccinates, alkylphosphates, alkenylphosphates, phosphate esters, lecithin, copolymers of poly(oxyalkylene) glycols and poly(12-hydroxystearic acid), and mixtures thereof.

10. An emulsion explosive composition according to claim 9 wherein said emulsifying agent is selected from the group consisting of 2-alkyl-4,4'-bis(hydroxymethyl-)oxazolines, 2-alkenyl-4,4'-bis(hydroxymethyl)oxazolines, the fatty acid esters of sorbitol, lecithin, copolymers of poly(oxyalkylene) glycols and poly(12-hydroxystearic acid), and mixtures thereof.

11. An emulsion explosive composition according to claim 9 or claim 10 wherein said emulsifying agent is selected from the group consisting of sorbitan monooleate, sorbitan sesquioleate, 2-oleyl-4,4'-bis(hydroxymethyl)oxazoline, a mixture of sorbitan sesquioleate, lecithin and a copolymer of poly(oxyalkylene)glycol and poly(12-hydroxystearic acid), and mixtures thereof.

12. An emulsion explosive composition according to any one of claims 1 to 11 inclusive wherein said emulsifying agent comprises from 0.1 to 2.0% by weight of the total composition.

13. An emulsion explosive composition according to any one of claims 1 to 12 inclusive wherein said aqueous phase comprises from 2 to 30% by weight of the total composition.

14. An emulsion explosive composition according to any one of claims 1 to 13 inclusive comprising a density reducing agent.

15. An emulsion explosive composition according to claim 14 wherein said density reducing agent is selected from the group consisting of fine gas bubbles, small glass or plastic hollow spheres or microballoons, porous particles, and mixtures thereof.

16. An explosive composition according to claim 14 or claim 15 wherein sufficient density reducing agent is used to give a composition having a density in the range from 0.9 to 1.4 g/cc.

17. An explosive composition according to any one of claims 1 to 16 inclusive which comprises a secondary fuel material.

18. An explosive composition according to claim 17 wherein said secondary fuel material is selected from: finely divided solids selected from the group consisting of sulfur, aluminium, gilsonite, coke, charcoal, carbon black, abietic acid, glucose, dextrose, starch, nut meal, grain meal, wood pulp and mixtures thereof; water-miscible organic liquids selected from alcohols, glycols, amines, and mixtures thereof; and mixtures thereof.

19. An emulsion explosive composition according to claim 17 or claim 18 wherein said secondary fuel is finely divided aluminium.

20. An emulsion explosive composition according to any one of claims 17 to 19 inclusive wherein said secondary fuel comprises up to 30% by weight of the total composition.

21. A process for the preparation of an emulsion explosive composition which comprises a discontinuous aqueous phase comprising at least one oxygen-releasing salt, a continuous water-immiscible organic phase comprising sump oil and an emulsifying agent, which process comprises:

(a) dissolving said oxygen-releasing salts in water at a temperature above the fudge point of the aqueous salt solution;

(b) combining said aqueous salt solution, said water-immiscible organic phase and said emulsifying agent with rapid mixing to form a water-in-oil emulsion;

(c) mixing until the emulsion is uniform; and (d) optionally mixing into the emulsion any solid ingredients and/or density reducing agents.

22. An emulsion explosive composition as defined according to any one of claims 1 to 20 inclusive substantially as herein described with reference to any one of Examples 1, 3 to 6, 8 and 10 to 20 inclusive.

23. A process according to claim 21 substantially as herein described with reference to any one of Examples 1, 3 to 6, 8 and 10 to 20 inclusive.

* * * * *